US006316117B1

(12) United States Patent
Hiramatsu et al.

(10) Patent No.: US 6,316,117 B1
(45) Date of Patent: Nov. 13, 2001

(54) STAINLESS STEEL SHEET HAVING CU-ENRICHED GRAINS DISPERSED IN ITS MATRIX AND/OR A CU-CONDENSED LAYER

(75) Inventors: Naoto Hiramatsu; Sadayuki Nakamura; Kazuyuki Kageoka, all of Shin-Nanyo (JP)

(73) Assignee: Nisshin Steel Co., Ltd. (JP)

( * ) Notice: Subject to any disclaimer, the term of this patent is extended or adjusted under 35 U.S.C. 154(b) by 0 days.

(21) Appl. No.: 09/666,662

(22) Filed: Sep. 20, 2000

(30) Foreign Application Priority Data

| | | |
|---|---|---|
| Sep. 21, 1999 | (JP) | 11-266607 |
| Mar. 2, 2000 | (JP) | 12-056700 |
| Mar. 30, 2000 | (JP) | 12-094837 |

(51) Int. Cl.[7] ..... B32B 15/04; C23C 8/06

(52) U.S. Cl. ..... 428/472.2; 148/282; 148/284; 428/613; 428/472.1; 428/913

(58) Field of Search ..... 428/613, 628, 428/632, 685, 472.1, 472.2, 931; 148/282, 284

(56) References Cited

U.S. PATENT DOCUMENTS 5,944,917 * 8/1999 Takeda et al. ..... 428/472.2

FOREIGN PATENT DOCUMENTS 63145793 6/1988 (JP) .

* cited by examiner

*Primary Examiner*—Robert R. Koehler
(74) *Attorney, Agent, or Firm*—Webb Ziesenheim Logsdon Orkin & Hanson, P.C.

(57) ABSTRACT

A new stainless steel sheet has a stainless steel substrate which contains Cu at a ratio of 1.0 wt. % or more and has Cu-enriched grains precipitated at a ratio of 0.2 vol. %. The Cu-enriched grains are exposed to the outside through pinholes in a passive film generated on the substrate. Cu is preferably condensed at a Cu/(Cr+Si) weight ratio of 0.1 or more or a Cu/(Si+Mn) weight ratio of 0.5 or more with respect to Cr, Si and Mn present in the passive film or at an outermost layer of the substrate. Precipitation of Cu-enriched grains and condensation of Cu effectively improve solderability and electric conductivity of the stainless steel sheet.

7 Claims, 1 Drawing Sheet

STAINLESS STEEL SHEET HAVING CU-ENRICHED GRAINS DISPERSED IN ITS MATRIX AND/OR A CU-CONDENSED LAYER

BACKGROUND OF THE INVENTION

1. Field of the Invention

The present invention relates to a stainless steel sheet having a passive film good of solderability and electric conductivity.

2. Background Art

A stainless steel sheet represented by SUS 430 or SUS 340 has good corrosion resistance due to a passive film present on its surface. The passive film comprises oxides and hydroxides, and contains metallic components such as Si, Mn other than Cr.

Oxides and hydroxides in the passive film are thermally stable but unfavorable for low-temperature bonding such as soldering. In order to improve solderability of a stainless steel sheet, the passive film is dissolved by a fluxing agent containing a strong acid such as hydrofluoric acid, or the stainless steel sheet is precoated with a metal layer such as Cu for good solderability. However, such a corrosive fluxing agent causes contamination of a surface of the stainless steel around the soldered joint, and the soldered stainless steel sheet is necessarily washed to remove the contaminants. Formation of a metal layer of good solderability requires a plating step before soldering which causes an increase in manufacturing cost.

Oxides and hydroxides in the passive film are also electrically insulative. In this regard, the stainless steel sheet can not be used as such for a can body of a battery, a spring member for fixing a battery, a contact part for an electric circuit or an electromagnetic relay, and so on. Although a copper alloy has been used so far as material for an electric contact due to its excellent electric conductivity, it has insufficient corrosion resistance, and a contact part made of the copper alloy loses its electric conductivity due to generation of rust. In this regard, JP 63-145793A disclosed a stainless steel sheet coated with a Ni layer useful as a contact part. The proposed contact part has good of corrosion resistance derived from stainless steel, and defects caused by a passive film are eliminated by the Ni layer. However, formation of a Ni layer means increase in manufacturing steps and requires an expensive electroplating or electroless plating method. Due to the Ni-plating, there is a big burden on processing of liquid wastes. If the Ni-layer is formed on a surface of a stainless steel sheet with poor adhesiveness, it is peeled off during forming or handling the stainless steel sheet.

SUMMARY OF THE INVENTION

The present invention aims at surface-reformation of a stainless steel sheet to a state good of solderability and electric conductivity without degrading excellent corrosion resistance of stainless steel itself. Such reformation is performed by precipitation of Cu-enriched grains in a matrix or condensation of Cu in a passive film or an outermost layer.

The newly proposed stainless steel sheet is characterized by a stainless steel, which contains Cu at a ratio of 1.0 wt. % or more and has the matrix that Cu-enriched grains are precipitated, and a passive film through which the Cu-enriched grains are exposed outside.

Condensation of Cu in the passive film as well as at an outermost layer is also effective for reformation of the passive film, instead of precipitation of Cu-enriched grains. Condensation of Cu up to the level that a mass ratio of Cu/(Cr+Si) is 0.1 or higher with respect to Cr and Si present in the passive film or at the outermost layer, remarkably improves solderability of the stainless steel. Condensation of Cu up to the level that a mass ratio of Cu/(Si+Mn) is 0.5 or higher with respect to Si and Mn present in the passive film or at the outermost layer, remarkably reduces contact resistance of the stainless steel.

A stainless steel sheet having Cu condensed to such a level does not need treatment for precipitation of Cu-enriched grains in its matrix. Of course, combination of Cu condensation with precipitation of Cu-enriched grains are more effective for improvement in solderability and electric conductivity.

There are no restrictions on the type of stainless steel in the present invention, as far as the stainless steel contains 1.0 wt. % or more of Cu. Various kinds of ferritic, austenitic, martensitic and dual-phase stainless steels may be used for the purpose.

Cu-enriched grains are sufficiently precipitated in a matrix of a stainless steel sheet by aging the stainless steel one hour or longer at a temperature about 800° C. at any stage until final annealing in a manufacturing process.

Condensation of Cu in the passive film or at the outermost layer of a stainless steel sheet is performed by bright-annealing the stainless steel sheet in an atmosphere at a dew point of −30° C. or lower at a final stage of a manufacturing process. Condensation of Cu is also performed by pickling a stainless steel sheet with mixed acids such as hydrofluoric-nitric acids or sulfuric-nitric acids. A surface of a stainless steel may be finished to a state suitable for an estimated use without any restrictions on surface-finishing, as far as exposure of Cu-enriched grains or condensation of Cu in a passive film or at an outermost layer is not diminished. For instance, such finishing as BA (cold-rolling and then bright-annealing), 2B (cold-rolling, heat treatment, pickling or other surface conditioning, and then cold-rolling to a state with proper glossiness) or 2D (cold-rolling, heat treatment, and then pickling or other surface conditioning to a state with proper glossiness), each regulated by JIS G0203, may be applied to a stainless steel sheet.

DETAILED DESCRIPTION OF THE INVENTION

A passive film present on a surface of a stainless steel sheet is mainly composed of chromium oxide and hydroxide effective in corrosion resistance. However, the chromium oxide and hydroxide are thermally stable and electrically insulative, so that the stainless steel has poor solderability and electric conductivity.

The inventors have researched and examined effects of surface conditions of a stainless steel on its solderability from various aspects, and discovered the fact that Cu-containing stainless steel is superior in solderability to other kinds of stainless steel. Especially, stainless steel, which contains Cu at a ratio of 1.0 mass % or more and has Cu-enriched grains precipitated in its matrix at a ratio of 0.2 vol. %, exhibits excellent solderability.

Figure 1:
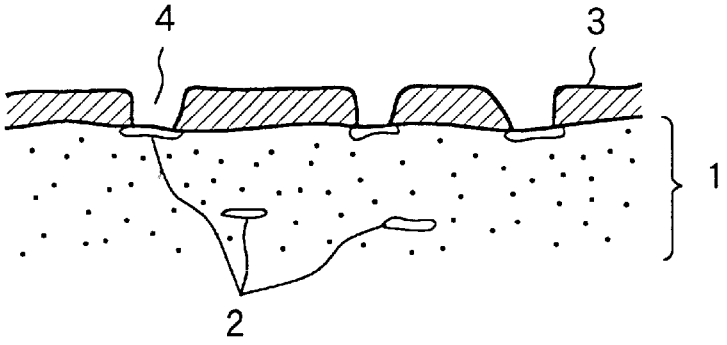
FIG. 1 is a exploded sectional view illustrating precipitation and dispersion of Cu-enriched grains in a matrix of a stainless steel sheet.

The inventors improvement of solderability by increase of Cu content and precipitation of Cu-enriched grains as follows: There is a passive film 3 on a stainless steel sheet 1 having Cu-enriched grains 2 precipitated in its matrix, but the passive film 3 is not generated at a surface part of a stainless steel substrate 1 where the Cu-enriched particles 2 are precipitated, as shown in FIG. 1. That is, the Cu-enriched grains 2 are exposed to the outside through pinholes 4 in the passive film 2. Since the grains 2 are mainly composed of Cu of superior of wettablility to a molten solder, the stainless steel sheet is well soldered even in presence of copper oxide.

Condensation of Cu in the passive film 3 or at an outermost layer of the stainless steel substrate 1 is also effective for solderability, regardless of Cu-enriched particles 2. Especially, when condensation of Cu is controlled at a weight ratio Cu/(Cr+Si) of 0.1 or more with respect to Cr and Si present in the passive film 3 or at the outermost layer of the stainless steel substrate 1, the surface of the stainless steel sheet is conditioned to a state well-wettable to a molten solder. Consequently, the conditioned surface exhibits excellent solderability, compared with a surface of a stainless steel sheet having a passive film containing large amounts of Cr and Si. Solderability is further improved by condensation of Cu in a passive film or at an outermost layer of a stainless steel having Cu-enriched grains precipitated in its matrix. Since a stainless steel can be soldered due to the conditioned surface without use of a corrosive fluxing agent or pretreatment such as Ni-plating, its applicability is broadened to various industrial fields.

The effect of precipitation of Cu-enriched grains 2 and condensation of Cu in passive film 3 or at an outermost layer of a stainless steel substrate 1 enables soldering a stainless steel sheet with a conventional Pb—Sn solder but also a Pb-free solder, which is expected as a main soldering material in future due to the harmful influences of Pb on the environment.

Precipitation of Cu-enriched grains and condensation of Cu are also effective for reducing contact resistance of a stainless steel sheet. Contact resistance of a stainless steel is remarkably reduced by precipitation of Cu-enriched grains at a ratio of 0.2 vol. %, or by condensation of Cu at a Cu/(Si+Mn) ratio of 0.5 or more in a passive film or at an outermost layer of a steel matrix containing 1.0 wt. % or more of Cu.

The inventors suppose that reduction of contact resistance is performed by Cu-enriched grains 2 which expose outside through pinholes 4 of passive film 3 and serve as parts of a passage for movement of electrons. Contact resistance of stainless steel is also reduced by condensation of Cu in passive film 3 or at an outermost layer of a stainless steel substrate 1, since electric conductivity of the passive film 3 or the outermost layer becomes higher as increase of Cu concentration, even in the case where Cu-enriched grains 2 are not precipitated in the stainless steel substrate 1. Reduction of contact resistance is distinctly noted when Cu is condensed at a Cu/(Si+Mn) weight ratio of 0.5 or more with respect to Si and Mn present in the passive film 3 or the outermost layer. Of course, electric conductivity is further improved by combination of condensation of Cu with precipitation of Cu-enriched grains 2 in the stainless steel substrate 1.

Precipitation of Cu-enriched grains or condensation of Cu in a passive film or at an outermost layer of a steel matrix is performed by using a stainless steel sheet containing 1.0 wt. % or more of Cu. The precipitation of Cu-enriched grains or condensation of Cu is promoted as increase of Cu content in the stainless steel substrate. However, excessive addition of Cu to stainless steel worsens hot-workability and productivity of a stainless steel sheet. In this sense, Cu content in the stainless steel is preferably kept at a value of 5 wt. % or less.

In the case where a stainless steel sheet has a matrix in which Cu-enriched grains are uniformly dispersed, a passive film containing Cr, Si and Mn is not generated on Cu-enriched grains. Consequently, Cu-enriched grains good of electric conductivity expose outside through pinholes of the passive film. The effects of Cu-enriched grains on solderability and electric conductivity are distinctly noted, when Cu-enriched grains are precipitated in the stainless steel substrate at a ratio of 0.2 vol. % or more.

Even if Cu-enriched grains are not precipitated in a stainless steel substrate, Cu is condensed in a passive film or at an outermost layer of a stainless steel substrate due to increased amount of Cu added to stainless steel. Such condensation of Cu is effective for solderability and electric conductivity. The effect of condensation of Cu on solderability is distinctly noted, when Cu is condensed at a Cu/(Cr+Si) weight ratio of 0.1 or more with respect to Cr and Si present in the passive film or at the outermost layer of the stainless steel substrate. On the other hand, the effect of condensation of Cu on electric conductivity is distinctly noted, when Cu is condensed at a Cu/(Si+Mn) weight ratio of 0.5 or more with respect to Si and Mn present in the passive film or at the outermost layer of the stainless steel substrate.

Precipitation of Cu-enriched grains 2 at an outermost layer is realized by aging a stainless steel sheet 1–24 hours at preferably 800° C. or so at any stage before final annealing in a manufacturing process. Aging treatment conditions are properly determined in response to Cu content in a stainless steel sheet, so as to precipitate fine Cu-enriched grains in the stainless steel matrix. Cu-enriched grains can be also precipitated during a continuous annealing step of a manufacturing process by controlling a cooling speed of an annealed stainless steel sheet at a relatively low value.

Condensation of Cu in passive film 3 or at the outermost layer is realized by bright-annealing a stainless steel sheet in an atmosphere of a dew point −30° C. or lower at a final stage of a manufacturing process. As the dew point of the annealing atmosphere becomes lower, oxidizing reaction on a surface of a stainless steel sheet is suppressed. Consequently, inclusion of easy-oxidizable metals such as Cr, Si and Mn in the passive film is suppressed, and metallic Cu or Cu oxide effective for solderability and electric conductivity is condensed in the passive film in return.

Condensation of Cu in passive film 3 or at an outermost layer of a stainless steel substrate 1 is also performed by acid-pickling after annealing in the open air, instead of bright-annealing. When a stainless steel sheet is annealed in the open air, scale containing oxides of Cr, Fe, Mn, Si and Cu is generated on surface of the stainless steel sheet. Such scale is dissolved off the stainless steel sheet by acid-pickling, and a passive film is generated on surface of the stainless steel sheet. If the stainless steel sheet is electrolytically pickled, Cu or Cu-enriched grains present at the outermost layer are preferentially dissolved off, resulting in formation of a passive film lacking Cu. The preferential dissolution of Cu or Cu-enriched grains is inhibited by pickling with mixed acids such as hydrofluoric-nitric acids or sulfuric-nitric acids. As a result, a passive film is generated after the acid-pickling without reduction of Cu concentration. There are no restrictions on the kind of the mixed acids, but a nitric acid solution mixed with hydrofluoric or sulfuric acid at a ratio of 10 vol. % or so is practically used.

EXAMPLE 1

Several kinds of cold-rolled stainless steel sheets having compositions shown in Table 1 were prepared. Some of the stainless steel sheets had been subjected to 24-hours heat treatment at 800° C. to precipitate Cu-enriched grains before final-annealing.

TABLE 1

STAINLESS STEEL SHEETS USED IN EXAMPLE

| | Alloying Components and Contents (mass %) | | | | | |
|---|---|---|---|---|---|---|
| Steel Kind | C | Si | Mn | Ni | Cr | Cu |
| SUS304 | 0.06 | 0.55 | 0.79 | 8.08 | 18.3 | 0.05 |
| SUS430 | 0.06 | 0.53 | 0.18 | 0.09 | 16.5 | 0.02 |
| SUS430J1L | 0.01 | 0.52 | 0.19 | 0.10 | 18.4 | 0.52 |
| A1 | 0.02 | 0.36 | 1.60 | 8.02 | 16.8 | 3.17 |
| A2 | 0.03 | 0.52 | 1.35 | 9.05 | 18.3 | 3.75 |
| F1 | 0.01 | 0.29 | 0.20 | 0.10 | 16.5 | 1.09 |
| F2 | 0.01 | 0.30 | 0.21 | 0.10 | 16.6 | 1.52 |

Metallurgical structure of each stainless steel sheet was observed by a transmission electron microscope (TEM), to calculate a ratio of Cu-enriched grains precipitated in a stainless steel matrix.

A sample cut off each stainless steel sheet was subjected to glow emission analysis to detect concentrations of Cu, Cr and Si at its outermost layer from intensities and contents in the matrix. Condensation of Cu in a passive film was calculated as a Cu/(Cr+Si) mass ratio from the detected concentrations of Cu, Cr and Si.

Furthermore, a sample cut off each stainless steel sheet is soldered with a Pb—Sn solder and a Pb-free solder each shown in Table 2, to research wettablility to a molten solder and tensile strength of a soldered joint.

TABLE 2

COMPOSITION OF SOLDERS (wt. %)

| Kind of Solder | Pb | Sn | Ag | Cu | rosin |
|---|---|---|---|---|---|
| Pb-Sn Solder | 39 | 59 | — | — | 2 |
| Pb-free Solder | — | 93.6 | 3.1 | 1.3 | 2 |

In a wettability test, a Pb—Sn or Pb-free solder (1 g) was put and melted on a sample, and a contact angle of the molten solder to the sample was measured. A contact angle of 90 degrees or more was regarded as poor wettability (×). A contact angle of 90–45 degrees was regarded as a little bit improved wettability(Δ). A contact angle of 45 degrees or less was regarded as excellent wettability(○).

Figure 2A:
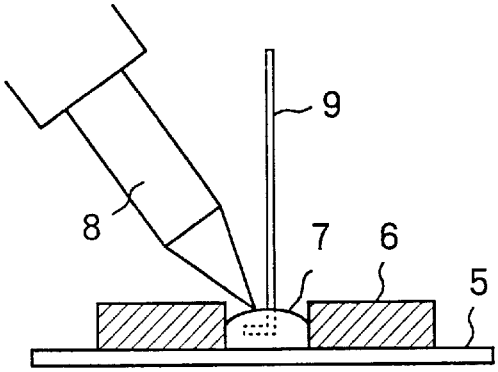
FIG. 2A is an elevation view illustrations preparation of a sample used for a test to determine tensile strength of a soldered part.
Figure 2B:
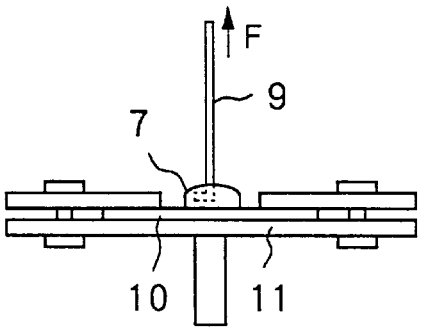
FIG. 2B is an elevation view for explanation of a tensile test.

A test piece 10 for a tensile test was prepared as follows. A bakelite ring 6 without solder wettability was mounted on a sample 5, a Pb—Sn solder 7 was applied to a circular surface (of 12 mm in diameter) of the sample 5 released from the bakelite ring 6 with a soldering iron 8, and a stainless steel wire 9 (of 2 mm in diameter) was inserted into the solder 7, as shown in FIG. 2A. The test piece 10 was clamped with a jig 11, and the stainless steel wire 9 was pulled with a tension F until the solder 7 was separated from the sample 5, as shown in FIG. 2B. Tensile strength (peeling strength) of the solder 7 was evaluated from the tension F at which the solder 7 was separated from the sample 5.

Test results are shown in Table 3.

Tabel 3 shows that Samples Nos. 1–3 had poor wettability and tensile strength due to an insufficient ratio (less than 1.0 wt. %) of Cu in the stainless steel substrate. Even if the stainless steel substrate contained Cu at a ratio of 1.0 wt. % or more, improvement in wettability or tensile strength was not realized unless Cu concentration of 0.1 wt. % or more at an outermost layer or precipitation of Cu-enriched grains at a ratio of 0.2 vol. % or more, as noted in Samples Nos. 4 and 5.

On the other hand, remarkable improvement in wettability and tensile strength was distinctly noted in Samples Nos. 8 and 12, which contained 1.0 wt. % or more of Cu and had Cu-enriched grains precipitated in the matrix at a ratio of 0.2 vol. % or more, and Samples Nos. 7 and 11, wherein Cu-enriched grains were precipitated at a ratio less than 0.2 vol. % but Cu was condensed at a ratio of 0.1 wt. % or more at an outermost layer. Especially, Samples Nos. 6, 9, 10 and 13, which had Cu-enriched grains precipitated in the matrix at a ratio of 0.2 vol. % or more and Cu concentration of 0.1 wt. % or more at an outermost layer, were excellent in wettability and tensile strength.

It is apparently recognized from the comparison that a surface of a stainless steel sheet is conditioned to a state of good solderability by precipitation of Cu-enriched grains exposed through a passive film and condensation of Cu in the passive film or at an outermost layer of a stainless steel substrate

TABLE 3

EFFECTS OF CU-ENRICHED GRAINS AND CONDENSATION OF CU ON WETTABILITY TO SOLDER AND TENSILE STRENGTH OF SOLDERED JOINT

| | | precipitation of Cu-enriched Grains | | condensation of Cu | wettability to | | tensile strength of a joint soldered with a Pb—Sn | |
|---|---|---|---|---|---|---|---|---|
| Sample No. | Steel Kind | treatment | a ratio (vol. %) | a Cu/(Cr + Si) weight ratio | Pb—Sn Solder | Pb-free solder | solder (N) | NOTE |
| 1 | SUS304 | no | tr. | 0.02 | x | x | 12 | COMPARSION |
| 2 | SUS430 | no | tr. | <0.01 | x | x | <10 | |
| 3 | SUS430J1L | no | ≦0.1 | <0.01 | x | x | <10 | |

TABLE 3-continued

EFFECTS OF CU-ENRICHED GRAINS AND CONDENSATION OF CU ON WETTABILITY TO SOLDER AND TENSILE STRENGTH OF SOLDERED JOINT

| Sample No. | Steel Kind | precipitation of Cu-enriched Grains: treatment | precipitation of Cu-enriched Grains: a ratio (vol. %) | condensation of Cu: a Cu/(Cr + Si) weight ratio | wettability to: Pb—Sn Solder | wettability to: Pb-free solder | tensile strength of a joint soldered with a Pb—Sn solder (N) | NOTE |
|---|---|---|---|---|---|---|---|---|
| 4 | A2 | no | ≦0.1 | 0.05 | x | x | 18 | |
| 5 | F2 | no | ≦0.1 | 0.03 | x | x | <10 | |
| 6 | A1 | no | 0.3 | 0.16 | Δ | Δ | 365 | PRESENT |
| 7 | A2 | no | ≦0.1 | 0.58 | Δ | ○ | 462 | INVENTION |
| 8 | A2 | yes | 0.6 | 0.08 | Δ | ○ | 248 | |
| 9 | A2 | yes | 0.6 | 1.70 | Δ | ○ | >500 | |
| 10 | F1 | yes | 0.4 | 0.68 | Δ | Δ | 94 | |
| 11 | F2 | no | ≦0.1 | 0.14 | Δ | Δ | 105 | |
| 12 | F2 | yes | 0.5 | 0.08 | Δ | Δ | 64 | |
| 13 | F2 | yes | 0.5 | 1.22 | Δ | ○ | 96 | |

EXAMPLE 2

Some of the stainless steel sheets shown in Table 1 were held at 24 hours at 800° C. to precipitate Cu-enriched grains, and then bright-annealed or annealed in the open air. The bright-annealing was performed in an atmosphere at a varied dew point. Stainless steel sheets annealed in the open air were either electrolytically pickled in a 5%-nitric acid solution or pickled in a mixed acid solution (6% nitric acid+2% hydrofluoric acid). The other stainless steels were bright-annealed, or open-air annealed and then acid-pickled without treatment for precipitation of Cu-enriched grains.

A counter electrode and a measuring terminal made of pure gold were held in contact with a surface of a sample cut off each stainless steel sheet, and contact resistance was measured in the state that 100 g load was added to the measuring terminal. A ratio of Cu-enriched grains and Cu concentration were also detected by the same way as in Example 1.

Test results are shown in Table 4.

A stainless steel sheet containing Cu at a ratio below 1.0 wt. % had poor of electric conductivity, as noted in Sample Nos. 1, 2 (SUS304), Sample No. 3 (SUS430) and Sample No. 4 (SUS430J1L). Contact resistance was still high, unless Cu concentration in a passive film or at an outermost layer exceeded 0.5 or precipitation of Cu-enriched grains in the matrix exceeded 0.2 vol. %, even when Cu content in a stainless steel sheet was more than 1.0 wt. %, as noted in Samples Nos. 5–7.

On the other hand, contact resistance of Samples Nos. 8–17, which contained Cu at a ratio of 1.0 wt. % or more and Cu-enriched grains precipitated at a ratio of 0.2 vol. % or more or Cu condensed in a passive film or at an outermost layer at a Cu/(Si+Mn) mass ratio of 0.5 or more, was sufficiently reduced. Especially, Sample Nos. 10, 13–15, 17, which satisfied both precipitation of Cu-enriched grains at a ratio of 0.2 vol. % or more and condensation of Cu at a Cu/(Si+Mn) weight ratio of of 0.5 or more, was remarkably reduced.

TABLE 4

EFFECTS OF CU-ENRICHED GRAINS AND CONDENSATION OF CU ON CONTACT RESISTANCE

| Sample No. | steel kind | processing conditions: treatment for precipitation of Cu-enriched grains | processing conditions: a dew point of an atmosphere for final annealing | processing conditions: pickling | Cu-enriched grains vol. % | Cu/(Si + Mn) weight ratio | contact resistance Ω | NOTE |
|---|---|---|---|---|---|---|---|---|
| 1 | SUS304 | no | open-air annealing | picking with mixed acids | tr. | <0.10 | ≧20 | COMPARISON |
| 2 | " | no | bright-annealing (−42° C.) | — | tr. | <0.10 | ≧20 | |
| 3 | SUS430 | no | bright-annealing (−44° C.) | — | tr. | <0.10 | ≧20 | |
| 4 | SUS430J1L | no | bright-annealing (−44° C.) | — | ≦0.1 | 0.15 | ≧20 | |
| 5 | A1 | no | bright-annealing (−26° C.) | — | ≦0.1 | 0.24 | 18 | |
| 6 | F1 | no | bright-annealing (−46° C.) | — | ≦0.1 | 0.22 | 18 | |
| 7 | F1 | no | open-air annealing | electrolytical pickling | ≦0.1 | <0.10 | 19 | |
| 8 | A1 | yes | bright-annealing (−44° C.) | — | 0.3 | 0.41 | 2.1 | PRESENT |
| 9 | A2 | no | open-air annealing | picking with mixed acids | ≦0.1 | 0.79 | 1.0 | INVENTION |
| 10 | " | yes | open-air annealing | picking with mixed acids | 0.6 | 1.15 | 0.2 | |
| 11 | " | no | bright-annealing (−44° C.) | — | ≦0.1 | 0.64 | 0.9 | |
| 12 | " | yes | bright-annealing (−36° C.) | — | 0.6 | 0.42 | 1.5 | |
| 13 | " | yes | bright-annealing (−44° C.) | — | 0.6 | 0.72 | 0.5 | |
| 14 | F1 | yes | bright-annealing (−46° C.) | — | 0.4 | 0.68 | 1.5 | |

TABLE 4-continued

EFFECTS OF CU-ENRICHED GRAINS AND CONDENSATION OF CU ON CONTACT RESISTANCE

| Sample No. | steel kind | processing conditions: treatment for precipitation of Cu-enriched grains | processing conditions: a dew point of an atmosphere for final annealing | processing conditions: pickling | Cu-enriched grains vol. % | Cu/(Si + Mn) weight ratio | contact resistance Ω | NOTE |
|---|---|---|---|---|---|---|---|---|
| 15 | F2 | yes | bright-annealing (−52° C.) | — | 0.5 | 1.01 | 1.1 | |
| 16 | " | no | open-air annealing | picking with mixed acids | ≦0.1 | 0.63 | 1.2 | |
| 17 | " | yes | open-air annealing | picking with mixed acids | 0.5 | 2.45 | 0.6 | |

Cu-enriched grains were precipitated by heating a stainless steel sheet 24 hours at 800° C.

A stainless steel sheet according to the present invention as above-mentioned has Cu-enriched grains precipitated in its matrix and exposed outside through a passive film, or Cu condensed in the passive film or at an outermost layer. Precipitation of Cu-enriched grains and condensation of Cu effectively improve solderability and reduce contact resistance of the stainless steel sheet.

Due to good solderability, the stainless steel sheet can be easily bonded to other parts with a Pb—Sn or Pb-free solder without using a corrosive fluxing agent containing hydrofluoric acid nor precoating with a Ni layer or the like. This feature broadens applicability of the stainless steel sheet to various uses such as electric parts, electronic parts, tools and variously, building material without degrading intrinsic property of stainless steel. Especially, electric or electronic parts made of the stainless steel sheet are operated with well performance due to good electric conductivity.

What is claimed is:

1. A stainless steel sheet which contains Cu at a ratio of 1.0 wt. % or more and has Cu-enriched grains precipitated at a ratio of 0.2 vol. % or more in its matrix, wherein said Cu-enriched grains are exposed to the outside through pinholes in a passive film formed on a surface of a stainless steel substrate.

2. A stainless steel sheet which contains Cu at a ratio of 1.0 wt. % or more and condensed at a Cu/(Cr+Si) weight ratio of 0.1 or more with respect to Cr and Si present in a passive film formed on a stainless steel substrate or at an outermost layer of a stainless steel substrate.

3. A stainless steel sheet which comprises a stainless steel substrate containing Cu at a ratio of 1.0 wt. % or more and condensed at a Cu/(Cr+Si) weight ratio of 0.1 or more with respect to Cr and Si present in a passive film formed on a stainless steel substrate or at an outermost layer of a stainless steel substrate and has Cu-enriched grains precipitated at a ratio of 0.2 vol. % or more in the stainless steel substrate.

4. A stainless steel sheet which contains Cu at a ratio of 1.0 wt. % or more and condensed at a Cu/(Si+Mn) weight ratio of 0.5 or more with respect to Si and Mn present in a passive film formed on a stainless steel substrate or at an outermost layer of the stainless steel substrate.

5. A stainless steel sheet which comprises a stainless steel substrate containing Cu at a ratio of 1.0 wt. % or more and condensed at a Cu/(Si+Mn) weight ratio of 0.5 or more with respect to Si and Mn present in a passive film formed on a stainless steel substrate or at an outermost layer of a stainless steel substrate and has Cu-enriched grains precipitated at a ratio of 0.2 vol. % or more in the stainless steel substrate.

6. A method of manufacturing a stainless steel sheet, which comprises the steps of:

preparing a stainless steel sheet containing Cu at a ratio of 1.0 wt. % or more; and bright-annealing said stainless steel sheet in an atmosphere at a dew point of −30° C. or lower, to condense Cu at a Cu/(Cr+Si) weight ratio of 0.1 or more or a Cu/(Si+Mn) weight ratio of 0.5 or more with respect to Cr, Si and Mn present in a passive film on a surface of a stainless steel substrate or at an outermost layer of the stainless steel substrate.

7. A method of manufacturing a stainless steel sheet, which comprises the steps of:

preparing a stainless steel sheet containing Cu at a ratio of 1.0 wt. % or more;

final-annealing said stainless steel sheet in an open atmosphere; and pickling the annealed stainless steel sheet with mixed acids, to condense Cu at a Cu/(Cr+Si) weight ratio of 0.1 or more or a Cu/(Si+Mn) weight ratio of 0.5 or more with respect to Cr, Si and Mn present in a passive film on a surface of a stainless steel substrate or at an outermost layer of the stainless steel substrate.

* * * * *